US007194970B2

(12) United States Patent
Srebro

(10) Patent No.: US 7,194,970 B2
(45) Date of Patent: Mar. 27, 2007

(54) EIGHT-POINT STAR AND METHOD OF MAKING

(75) Inventor: Nancy I. Srebro, Tunkhannock, PA (US)

(73) Assignee: Silver Star, Inc., Tunkhannock, PA (US)

( * ) Notice: Subject to any disclaimer, the term of this patent is extended or adjusted under 35 U.S.C. 154(b) by 113 days.

(21) Appl. No.: 10/728,601

(22) Filed: Dec. 4, 2003

(65) Prior Publication Data

US 2004/0244664 A1 Dec. 9, 2004

Related U.S. Application Data

(60) Provisional application No. 60/470,615, filed on May 14, 2003.

(51) Int. Cl.
*D05B 11/00* (2006.01)

(52) U.S. Cl. ..... 112/475.08; 112/475.18; 112/117

(58) Field of Classification Search ..... 112/475.18, 112/475.08, 475.22, 117, 439, 440, 441; 33/17 R, 33/4, 11; D5/58, 60
See application file for complete search history.

(56) References Cited

U.S. PATENT DOCUMENTS 3,766,654 A * 10/1973 Canton ..... 33/565
3,898,943 A * 8/1975 Braden et al. ..... 112/475.08
3,913,509 A * 10/1975 Ramon ..... 112/408
4,053,986 A * 10/1977 Axelrod ..... 33/17 R
4,646,666 A * 3/1987 Burrier ..... 112/475.22
4,912,850 A * 4/1990 Gray ..... 33/1 G
5,272,995 A * 12/1993 Harger ..... 112/475.08

OTHER PUBLICATIONS

S. Schneider, "Scrap Frenzy: Even More Quick–Pieced Scrap Quilts," Martingale & Co., Woodinville, Washington, 2001, pp. 1–28, 46–51, and 57–63.

Ohio Star Variation, Quiltaholics, 1998, http://www.quiltaholics.com.*

5–Star Block, McCalll's Quilting, 2003, http://mccallsquilting.com.*

* cited by examiner

*Primary Examiner*—Ismael Izaguirre
(74) *Attorney, Agent, or Firm*—Seed IP Law Group PLLC

(57) ABSTRACT

A method of forming a fabric block that depicts an eight-point star by using only square-shaped and rectangular-shaped pieces of fabric. A square-shaped piece of fabric is sewn to a first rectangular-shaped piece of fabric and this combination is sewn to a second rectangular shaped piece of fabric to form a square-shaped fabric segment that is sewn to a second square-shaped fabric segment to form a square-shaped quarter portion depicting two points of the star. The four square-shaped quarter portions are sewn together resulting in a square-shaped fabric block depicting an eight-point star. This method overcomes the challenges and difficulties encountered when attempting to make an eight-point star design from diamond, triangle, and square geometric shapes.

15 Claims, 8 Drawing Sheets

=

EIGHT-POINT STAR AND METHOD OF MAKING

This application claims the benefit of Provisional Application No. 60/470,615, filed May 14, 2003.

BACKGROUND OF THE INVENTION

1. Field of the Invention

The present invention pertains to sewing methods and articles made therefrom, and more specifically to methods and techniques used to make eight-point star designs such as used in sewing, textile and fabric arts, and quilt making.

2. Description of the Related Art

For centuries mankind has sewn together small pieces of textiles, cloth or fabric to make larger pieces. In antiquity this was done by handwork, until the invention of the mechanical sewing machine in the 1800's. Most modern sewing is done using a sewing machine, although hand sewing is still done of necessity or because it is more traditional for specialty applications.

Textile and fabric art have also existed for many centuries. These art forms seek to create attractive and decorative combinations of textured, printed or colored textiles, cloth or fabrics. Geometric designs, such as a triangle or trapezoid, may be formed by sewing small pieces together. Likewise, more complex designs may be sewn, for example a pinwheel or a star. These designs may be used individually or in combination with other like or unlike geometric designs to create a larger piece, such as a wall hanging, quilt or mural. Textile and fabric art may also be used to decorate clothing.

One geometric design that has been used in fabric art and quilt making since the early 1800's is the eight-point star. The eight-point star design is encountered perhaps more frequently than any other geometric design. The traditional technique for creating the eight-point star design is to cut and sew eight diamond shapes, together with four square shapes, and with four triangle shapes. A set of directions or "pattern" as it is termed is generally provided to the artist to show the sewing method or technique. Although the pattern may specify that different size diamonds, triangles, and squares are cut to suit the finish size desired, all eight-point stars are currently made by means of the traditional technique that combines diamonds, triangles, and squares.

Referring to FIG. 1, shown therein is a top plan view of an assembled eight-point star (S) formed using the traditional method. As shown therein, the eight-point star is comprised of three geometric shapes sewn together, typically using a seam allowance of one-quarter inch. The shape includes the square (shape A), a quarter-square triangle (shape B), and 45-degree diamonds (shape C).

The sewing instructions for the traditional eight-point star illustrated in FIG. 1 are as follows:

In step 1, the diamonds C are sewn into pairs. As shown in FIG. 2, two diamonds C, C are overlaid and pinned together along one edge. In order to avoid set-in seam problems, dark dots on the diamonds shown in FIG. 2 designate the point at where sewing is stopped, typically one-quarter inch from the adjacent edge. At this point the seam is backtacked. Backtacking is a method of sewing in reverse. Generally, the seam is backtacked three stitches. The set of diamonds is then pressed in the direction shown by the arrow in FIG. 2.

Step 2 is the making of a half-star. In step 2, two diamond pairs are overlaid and sewn together to make a half-star. As shown in FIG. 3, sewing is stopped approximately one-quarter inch from the bottom of the diamond pair edge (shown with the dark dots) following which the seam is backtacked. The finished half-star is then pressed according to the direction of the arrow as shown in FIG. 3. This step is repeated for the other half of the star.

Step 3 involves sewing the two half-stars together, as shown in FIG. 4. First, the two half-stars are overlaid and pinned together. To avoid set-in seam problems, sewing is commenced one-quarter inch from one end of the diamond edge (at the dark dots), backtacked, and sewing is stopped at the other end of the C diamond edge (at the dark dots) and finished with backtack. With the two half-stars sewn together, it does not matter which way the center seam is pressed.

In step 4, the quarter-square triangles (B) are sewn to the exposed edges of the diamonds. With the wrong side of the diamond facing the sewer, in this case the back side, the quarter-square triangle (B) is pinned to the side of the diamond. Sewing is commenced from the outside tip of the diamond. Sewing should stop at approximately one-sixteenth of an inch from the inside of the diamond seamline (at the dark dots shown in FIG. 5), which is followed by backtack. The thread is then cut and the pieces are removed from the machine. With the back or wrong side of the quarter-square triangle (B) facing the sewer, it is pinned to the diamond. Sewing commences and stops at one-sixteenth of an inch from the inside diamond seamline (at the dark dots), after which it is finished with backtack. The finished section is pressed in the direction towards the quarter-square triangle (B). All four sides are finished in this manner.

In step 5, shown in FIG. 6, the squares (A) are sewn to the exposed edges of the diamonds (C). With the wrong-side of the diamond facing outward, the square (A) is pinned thereto. Sewing is started and stopped one-sixteenth of an inch from the inside of the diamond seamline (at the dark dots), following which sewing is completed with backtack. The thread is then cut and the pieces are removed from the machine. The foregoing is repeated for the other side of the square (A). The seam is then pressed toward the square (A). All four squares are sewn in this manner.

It should be noted that when setting in seams, sewing should always stop one-sixteenth of an inch from the inside diamond seams and then backtacked. By doing this, a pleat will not be formed on the front of the star. If sewing is stopped more than one-sixteenth of an inch from the inside diamond seams, a hole (unsewn area) will be formed.

One disadvantage of the traditional technique of making eight-point star designs is that the accurate cutting of diamond and triangle-shaped pieces of textiles or fabrics is much more difficult than cutting a simple square. This is because the sides of the diamonds and triangles must be cut at exact angles that are difficult to achieve with conventional rulers. If accurate cutting is not done, the sewing and assembly of a visually appealing eight-point star design cannot be accomplished because the individual component pieces have slightly different dimensions. The finished eight-point star will neither be symmetrical nor will it lay flat. This disadvantage is widely known to fabric artists who use the terminology "ripping out" to describe the tedious removal of sewing stitches to attempt additional sewing so the eight-point star design will be symmetrical and lay flat when assembled.

Another disadvantage of the traditional and current technique to make the eight-point star design is that the diamonds, triangles, and squares are cut from textile, cloth or fabric that is manufactured in looms. This production process causes the individual fiber threads to lay parallel and perpendicular to each other. When the diamond and triangle pieces are sewn together into the eight-point star design, the sewing threads do not run parallel with the fiber threads, because the diamonds and triangles have 45-degree angular sides. Thus, the tension of the sewing threads tends to stretch and distort the diamond and triangle pieces, making the accurate assembly of the eight-point star very difficult. This disadvantage is also known to fabric artists and quilt makers, who commonly refer to sewing on "bias edges" to describe the difficulty encountered when the sewing threads cannot run parallel with the individual fiber threads.

A further disadvantage of the traditional technique that uses diamonds and triangles in the eight-point star design is that the sewing must be precisely controlled at the points where three stitching lines intersect. This is commonly referred to as the Y point. If the sewing goes even slightly beyond the intersection point, a pleat is formed that is visually unacceptable. Likewise, if the sewing is even slightly short of the intersect point, a hole is created that is equally unacceptable. This disadvantage is referred to as sewing "set-in seams." Because of these difficulties, set-in seams or Y seams are avoided by all but the most experienced and skillful artists.

In summary, there are many challenges and difficulties encountered by textile and fabric artists when making the eight-point star design from diamond, triangle, and square geometric shapes. Hence there is a need for an easier and more accurate method for forming eight-point stars.

BRIEF SUMMARY OF THE INVENTION

The disclosed embodiments of the invention are directed to an entirely new method to make the eight-point star design using only square and rectangle geometric shapes, as compared with the traditional combination of diamonds, triangles, and squares. This method or technique is highly innovative and is currently unknown amongst fabric artists and quilt makers. The embodiment of the invention described herein overcomes the substantial difficulties encountered when sewing the eight-point star design using the traditional technique described above.

In accordance with one embodiment of the invention, a method for forming an eight-point star is provided that includes forming four square-shaped quarter portions, each quarter portion depicting two points of an eight-point star, and attaching the four square-shaped quarter portions together to form a square-shaped block having an eight-point star formed thereon.

In accordance with another aspect of the foregoing embodiment, the square-shaped quarter portions are formed by attaching two rectangular pieces together to form a first square-shaped segment; attaching two additional rectangular pieces together to form a second square-shaped segment; and attaching the first and second square-shaped segments together to form the square-shaped quarter portion.

In accordance with another aspect of the foregoing embodiment, the rectangular pieces are formed of a first rectangular-shaped piece and a square-shaped piece sewn together. In accordance with another aspect of the present invention, a method for forming a fabric block depicting an eight-point star is provided that comprises sewing a square to a rectangular-shaped piece then sewing this combination to a rectangle to form a square-shaped fabric piece; sewing the two square-shaped fabric pieces together to form a square-shaped quarter portion that depicts two points of a star; and sewing the four square-shaped quarter portions together to form a fabric block depicting an eight-point star.

In accordance with another embodiment of the invention, a fabric block depicting an eight-point star is provided, the fabric block comprising four square-shaped fabric quarter portions sewn together, each of the four square-shaped quarter portions depicting two points of the eight-point star and comprising two square-shaped fabric segments sewn together, each square-shaped fabric segment formed from two rectangular-shaped fabric pieces sewn together, one of these rectangular-shaped pieces is comprised of a square sewn to a rectangle.

In accordance with another aspect of the invention, one of these rectangular pieces is formed of a rectangular-shaped piece sewn to a square-shaped piece, and the rectangular-shaped piece consists of material that is visually contrasting to the square-shaped piece.

In accordance with another embodiment of sewing an eight-point star, a method is provided that includes aligning a square on a lower part of a rectangle and attaching the same together with a stitching line, then trimming away a lower left corner of the combined square and rectangle to form a first combination; forming three additional first combinations; attaching one first combination to a respective large rectangle to form a first unit; forming three additional first units; aligning a square on a lower part of a rectangle and attaching the square to the rectangle with a stitching line and removing a lower right corner to form a second combination; forming three additional second combinations; attaching one second combination to a large rectangle to form a second unit; forming three additional second units; placing one second unit on top of one first unit with the front sides facing each other and attaching the same together with a stitching line to form a square-shaped quarter portion; trimming away the upper right corner of the square-shaped quarter section; forming three additional square-shaped quarter portions; attaching two square-shaped quarter portions to form a rectangular half-star; forming an additional rectangular half-star; and attaching two rectangular half-stars together to form a square-shaped eight-point star.

In accordance with another aspect of the forgoing embodiment, the first combination is formed by having the stitching line sewn diagonally from an upper left corner of the square to the lower right corner of the square, and the second combination is formed by having the stitching line sewn from an upper right corner to a lower left corner of the square.

In accordance with another embodiment of the invention, an eight-point star formed of fabric is provided, comprising:

- two rectangular half-stars sewn together to form a square-shaped eight-point star, each rectangular half-star comprising:
  - two square-shaped quarter portions attached together, each square-shaped quarter portion comprising:
    - square-shaped first and second units attached together, each of the first and second units comprising a rectangular-shaped first combination attached to a rectangular-shaped piece, each of the first and second combinations comprising a square-shaped piece of material attached to a lower portion of a rectangular-shaped piece of material.

Square and rectangle shaped pieces of textiles or fabrics are very easy to measure and to cut precisely because their sides are exactly perpendicular to each other. Since the sides of square and rectangle geometric shapes are perpendicular, i.e., at 90-degrees, very accurate cutting can be done using the scale on conventional rulers as are used by fabric artists.

Thus, all the cut shapes are more likely to have the exact same dimensions; and the sewing and assembly of a visually appealing eight-point star design can be accomplished much more easily than if angular geometric shapes such as diamonds and triangles were used. The finished eight-point star design is more likely to be symmetrical and lay flat. "Ripping out" to remove stitching and to re-sew the seam will be eliminated or reduced to a large extent.

As described previously, the cloth or fabric used to make the eight-point star design is manufactured in looms. This production process causes the individual fiber threads to lay parallel and perpendicular to each other. When sewing the square and rectangle shaped component pieces using the method of the invention, the sewing threads are diagonal to the fabric threads but the angular cut has not yet been made. Thus, the tension of the sewing threads is much less likely to stretch and distort the square and rectangle pieces than it would if the component pieces had angular cut sides, as when diamonds and triangles are used. The disadvantage of sewing on "bias edges" will be totally eliminated.

Moreover, since the method of the present invention uses only squares and rectangles as component pieces, no intersection points are formed where three stitching lines come together. Accordingly, there are no Y seams as described previously, and the need is totally eliminated to precisely control the sewing so it stops exactly on the intersect point. Thus, pleats cannot be formed where the sewing overruns, nor holes left where the sewing stops short. The method or technique of the invention will allow less accomplished fabric artists to create excellent eight-point star designs, whereas previously only the most skillful artisans were able to do so.

To summarize, the method or technique of the invention eliminates the use of angular geometric shapes, i.e., diamonds and triangles, as components of the eight-point star design that is widely used in fabric art and quilt making. Thus the difficulties in accurately cutting and sewing these geometric shapes are avoided. Also, it totally avoids the need for sewing "set-in seams," or Y seams, at the stitching intersection points because no set-in or Y seams are formed with the method of the invention method.

BRIEF DESCRIPTION OF THE SEVERAL VIEWS OF THE DRAWINGS

The foregoing features and advantages of the present invention will be more readily appreciated as the same become better understood from the following detailed description when taken in conjunction with the accompanying drawings, wherein.

DETAILED DESCRIPTION OF THE INVENTION

Figure 1:
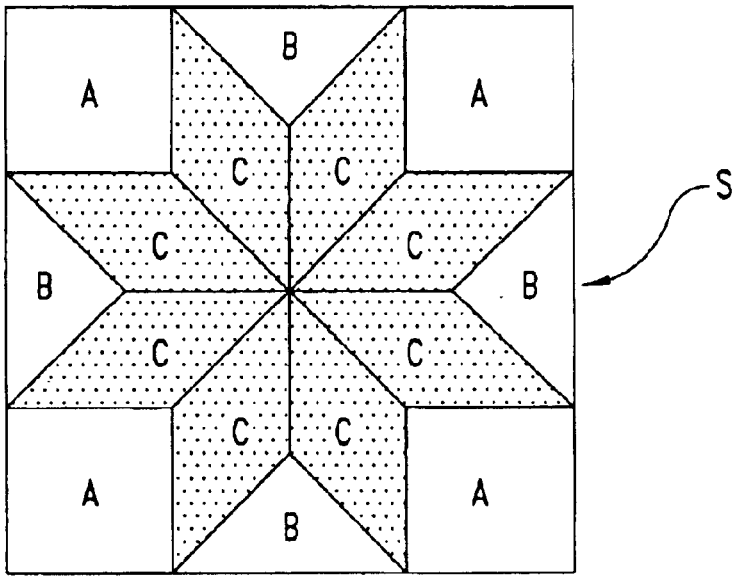
FIG. 1 (Prior Art)
FIG. 1 is a top plan view of an eight-point star formed in accordance with a known method.
Figure 2:
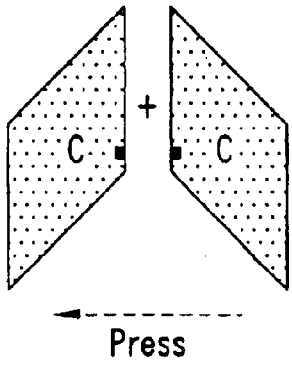
FIG. 2 (Prior Art)
FIG. 2 illustrates a first step of sewing the two diamonds into a pair for forming the eight-point star of FIG. 1.
Figure 3:
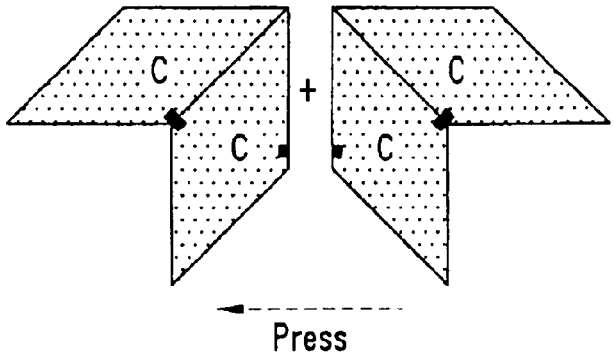
FIG. 3 (Prior Art)
FIG. 3 illustrates sewing two diamond sets together.
Figure 4:
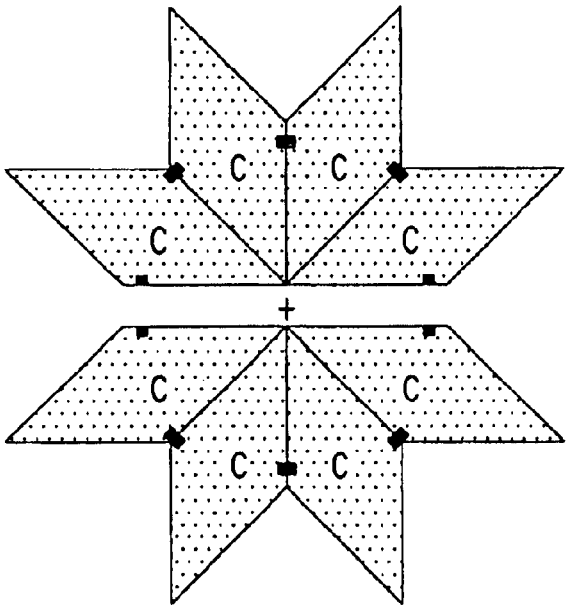
FIG. 4 (Prior Art)
FIG. 4 illustrates sewing two halves of the eight-point star together.
Figure 5:
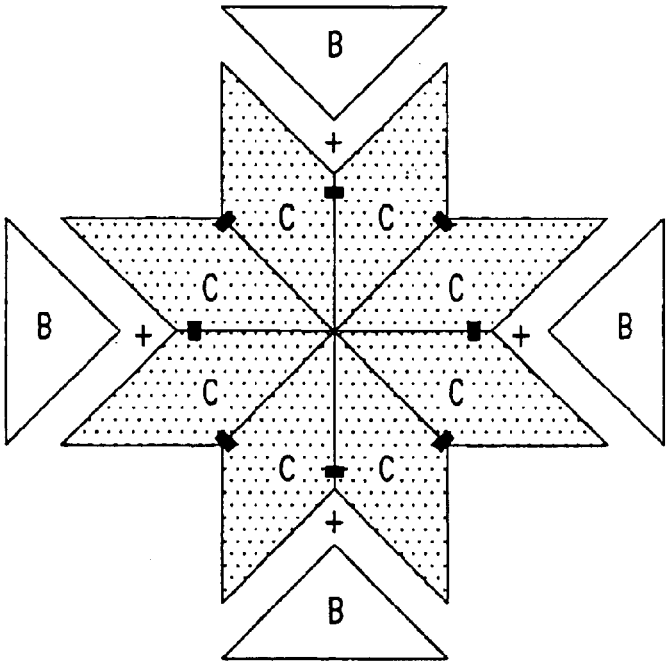
FIG. 5 (Prior Art)
FIG. 5 illustrates attachment of quarter-square triangles to the sides of the sewn halves.
Figure 6:
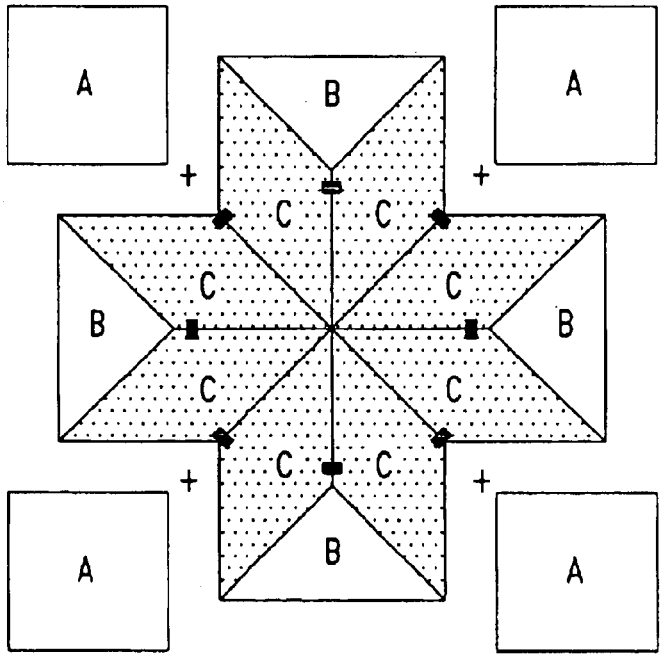
FIG. 6 (Prior Art)
FIG. 6 illustrates the attachment of square sections to the corners of the sewn halves to form the eight-point star of FIG. 1.
Figure 7:
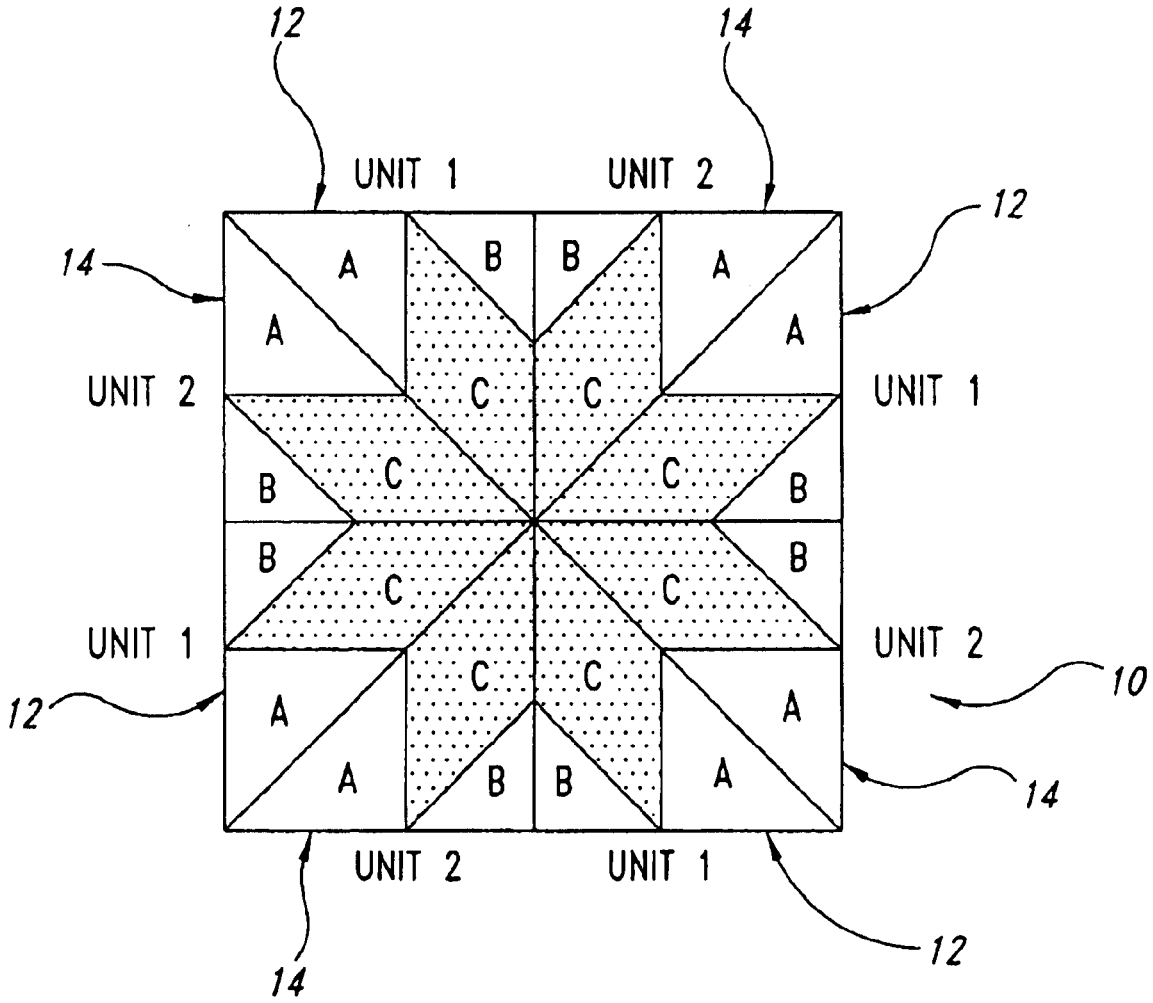
FIG. 7 is a top plan view of an eight-point star formed in accordance with the method of the present invention.
Figure 8:
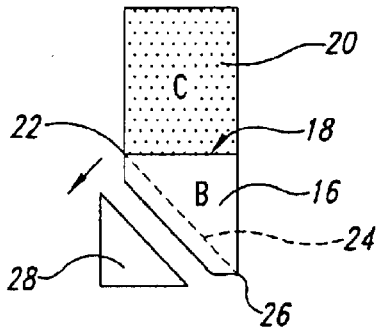
FIG. 8 is an illustration of a first step in accordance with the method of the present invention.

Referring initially to FIG. 7, shown therein is a top plan view of an eight-point star 10 formed in accordance with the method of the present invention. As discussed above, this method utilizes the attachment of rectangles and squares to form an eight-point star that avoids the disadvantages of the known method that is typically used. Preferably, in the method of the present invention a ¼ inch seam allowance is used when sewing the component pieces together. It is to be understood that the drawings are not necessarily to scale and are for illustrative purposes only. The star 10 is constructed of a plurality of first units 12 and second units 14 sewn together. The construction of the first unit 12 is illustrated and described in steps 1 and 2 and illustrated in accompanying FIGS. 8 and 9; and the construction of the second unit 14 is described and illustrated in steps 3 and 4 and illustrated in accompanying FIGS. 10 and 11.

Figure 9:
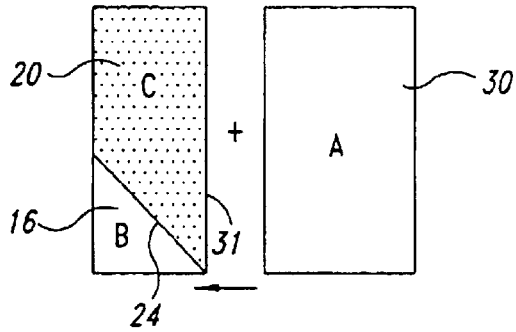
FIG. 9 is an illustration of a second step of the method of the present invention.

In step 1 the front sides of two fabric panels are placed facing each other. A square 16 (designated B in FIG. 8) is placed on the top of lower part 18 of a rectangle 20 (designated C in FIG. 8). Ideally, the square 16 has the same width of the rectangle 20 but is approximately one-half of the length of the rectangle 20. Starting in the upper left corner 22 of the square 16, a stitching line 24 is sewn diagonally to a lower right corner 26. The lower left corner 28 of the square 16 and of the underlying rectangle 20 is then cut approximately one-quarter inch away from the stitch line 24 and discarded. The combination is then pressed in a direction away from the rectangle 20. The remaining flap of the square 16 is folded down along the stitching line and pressed to form the rectangle 20 as shown in FIG. 9.

In step 2, a large rectangle 30 (designated A in FIG. 9) is sewn to the right side 31 of the rectangle 20 to form the first unit 12. The seam is pressed in the direction of the arrow. Steps 1 and 2 are repeated three additional times to form a total of four first units 12. The large rectangle 30 has the same length as the rectangle 20, but is slightly wider to achieve the correct dimensions when assembled.

Figure 10:
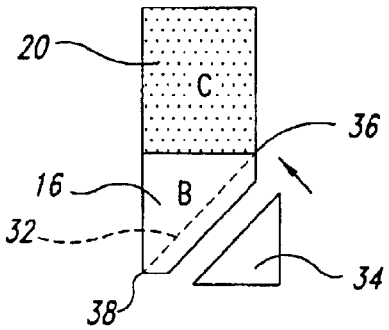
FIG. 10 is an illustration of a third step of the method of the present invention.

Turning next to steps 3 and 4, in step 3, with the front sides of the fabric facing each other, a square 16 is placed on the lower part of a rectangle 20 as in step 1. Starting at the upper right corner 36 of the square 16, a stitching line 32 is sewn diagonally to the lower left corner 38, as shown in FIG. 10. The lower right corner 34 of the square 16 and the underlying rectangle 20 is then cut approximately one-quarter inch away from the stitching line 38 and discarded. The resulting combination is pressed in a direction toward the rectangle 20. The remaining flap of the square 16 is folded down along the stitching line and pressed to form the rectangle 20 as shown in FIG. 11.

Figure 11:
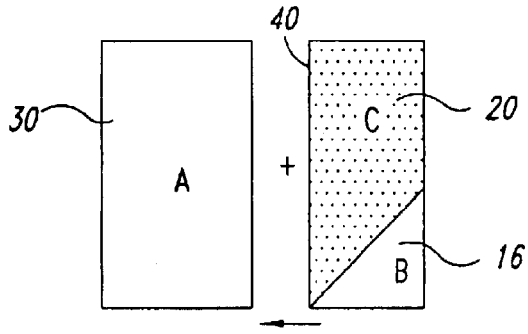
FIG. 11 is an illustration of a fourth step of the method of the present invention.
Figure 12:
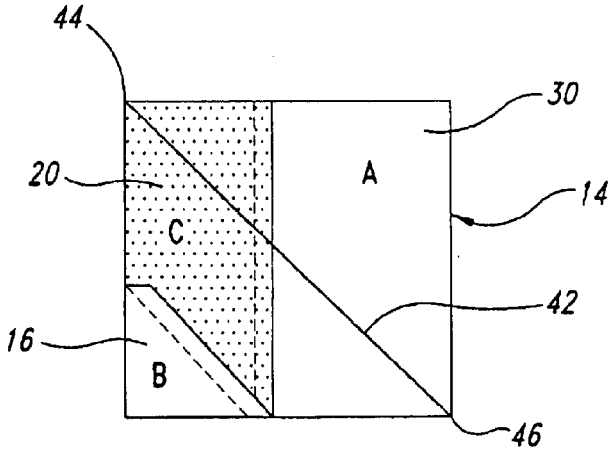
FIG. 12 is an illustration of a fifth step of the method of the present invention.

In step 4, a large rectangle 30 is sewn to the left side 40 of the rectangle 20, as shown in FIG. 11. This forms the completed second unit 14. The seam is pressed in the direction of the arrow. Steps 3 and 4 are repeated three additional times to form four second units 14. The large rectangle 30 has the same length as the rectangle 20, but is slightly wider to achieve the correct assembled dimensions.

In FIGS. 12–14B the construction of a square-shaped quarter portion is illustrated. In step 5, shown in FIG. 12, on the back side of the second unit 14 where the seams are shown, a pencil line 42 is drawn diagonally from an upper left corner 44 to a lower right corner 46. This pencil line 42 is drawn on the back side of all of the second units 14.

Figure 13A:
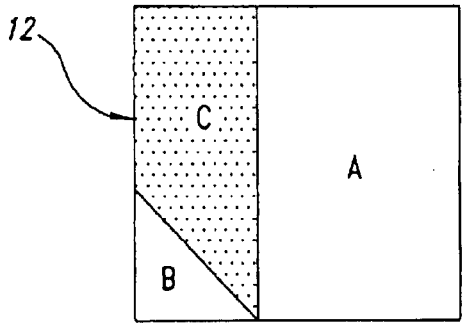
FIGS. 13A—13B are illustrations of a sixth step of the method of the present invention.
Figure 13B:
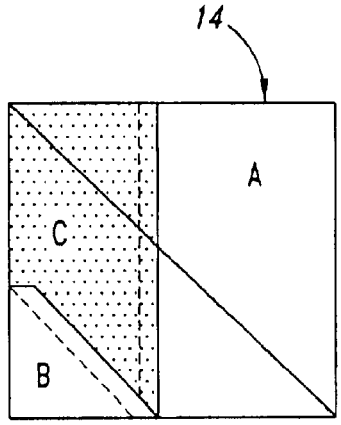

In step 6, the front side of the first unit 12, shown in FIG. 13A, and the front side of the second unit 14, shown in FIG. 13B, are placed facing each other with the second unit 14 on top of the first unit 12. The two units 12, 14 are aligned and pinned together with the pencil line 42 on top.

Figure 14A:
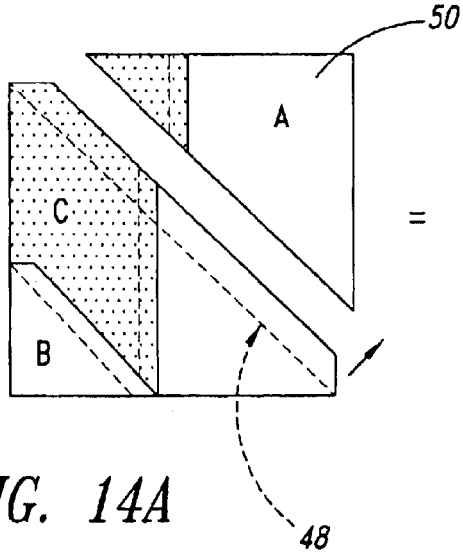
FIGS. 14A—14B are illustrations of a seventh step of the method of the present invention.
Figure 14B:
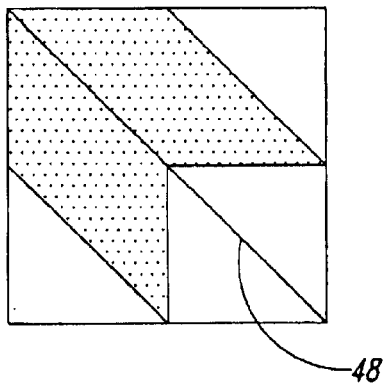

In step 7, shown in FIGS. 14A–14B, a stitching line 48 is sewn along the pencil line through the first and second units 12, 14 from the upper left corner 44 to the lower right corner 46, shown more particularly in FIG. 14A. The upper right section 50 of the combined units 12, 14 is then trimmed approximately one-quarter inch away from the stitching line and discarded. The seam is then pressed towards the second unit 14, forming the quarter portion depicted in FIG. 14B when unfolded. Steps 5–7 are repeated three additional times to form four of the square-shaped quarter portions.

Figure 15A:
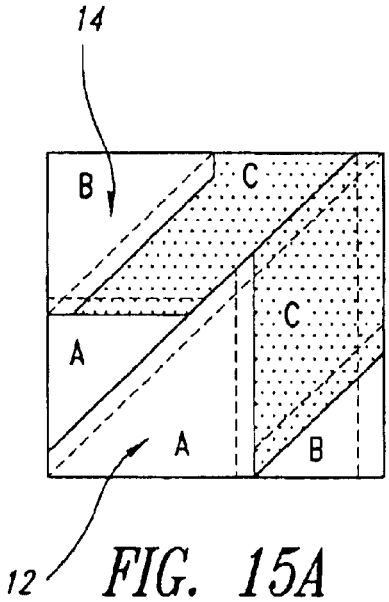
FIGS. 15A—15B are illustrations of an eighth step of the method of the present invention.
Figure 15B:
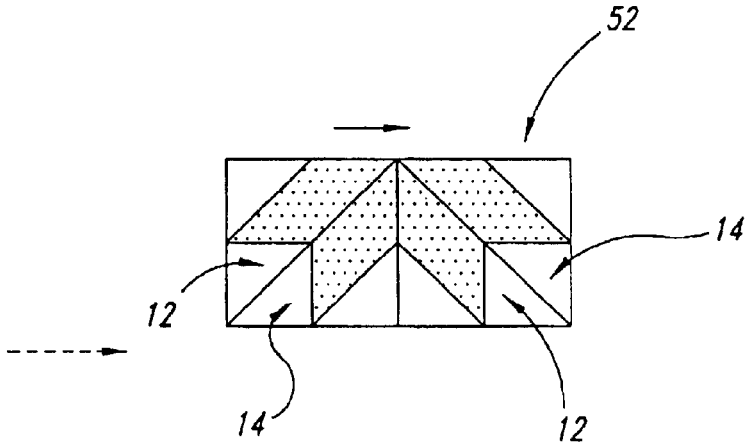

In step 8, a half-star 52 is formed from the combinations previously sewn in steps 5–7. Referring to FIG. 15A, with the front sides facing each other, two of the combinations are sewn together to make the half-star 52, shown in FIG. 15B. The seam is pressed in the direction of the arrow shown in FIG. 15B. This forms one-half of the completed star 10.

Figure 16B:
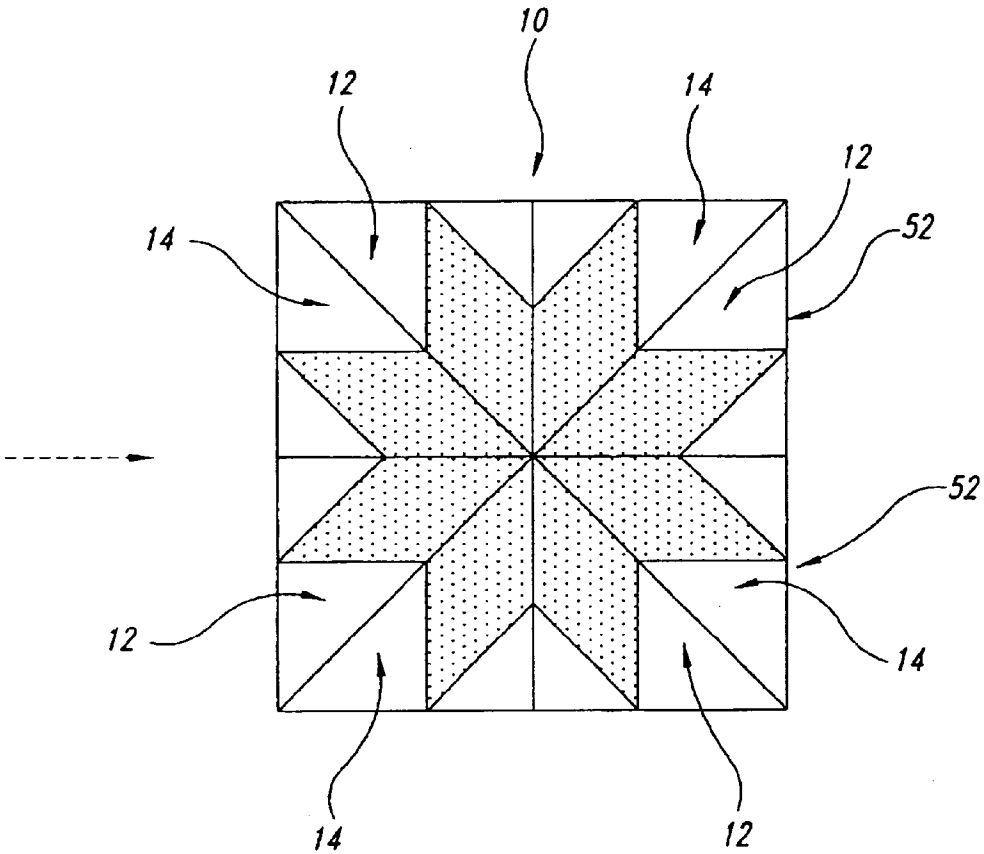
FIGS. 16A—16B are illustrations of a ninth step of the method of the present invention.
Figure 16A:
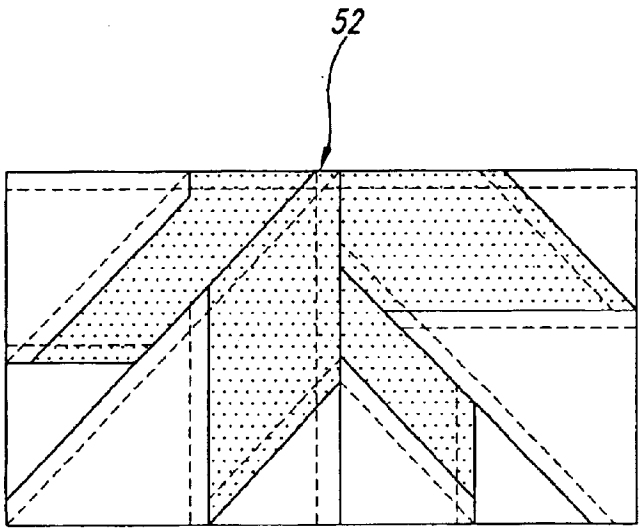

In step 9, two half-stars 52 are sewn together as shown in FIGS. 16A–16B. The direction of the pressing of the seam does not matter with the completed star 10.

Representative dimensions to obtain a 10-inch block are as follows: Rectangle A—3½ inches by 5½ inches; Square B—2½ inches; and Rectangle C—2½ inches by 5½ inches. For a 12-inch finished block, the dimensions are: Rectangle A—4 inches by 6½ inches; Square B—3 inches; and Rectangle C—3 inches by 6½ inches.

While a preferred embodiment of the present invention has been illustrated and described, it is to be understood that various changes may be made therein without departing from the spirit and scope of the invention. For example, the use of rectangle or square pieces or both that are combinations of smaller pieces, preferably squares and rectangles, may be used. Hence, the invention is to be limited only by the scope of the appended claims that follow and the equivalents thereof.

What is claimed is:

1. A method of sewing an eight-point star, comprising:

aligning a square on a lower part of a rectangle and attaching the same together with a stitching line sewn diagonally from an upper left corner of the square to the lower right corner of the square, and trimming away a lower left corner of the combined square and rectangle to form a rectangular first combination;

attaching the first combination to a rectangle piece to form a square-shaped first unit;

forming three additional first units;

aligning a square on a lower part of a rectangle and attaching the square to the rectangle with a stitching line formed from an upper right corner to a lower left corner of the square, and removing a lower right corner of the combined square and rectangle to form a rectangular second combination;

forming three additional second combinations;

attaching the second combination to a rectangle piece to form a square-shaped second unit;

forming three additional second units;

placing a second unit on top of a first unit with front sides facing together and attaching the same together with a stitching line formed from an upper left corner to a lower right corner, and cutting off an upper right corner of the combined first and second units to form a square-shaped quarter portion;

forming three additional quarter portions;

attaching two square-shaped quarter portions together to form a rectangular half-star; and attaching two rectangular half-stars together to form a square-shaped eight-point star.

2. The method of claim 1, wherein the rectangle first combination is formed to visually contrast the material of the square piece with the material of the rectangle piece.

3. A method of forming an eight-point star, comprising:

forming four square-shaped quarter portions, each quarter portion depicting two points of the eight-point star, the square-shaped quarter portions are each formed from a first square-shaped segment attached to a second square-shaped segment and attached along a line formed diagonally from a first corner to a second corner, wherein the first square-shaped segment and second square-shaped segment are each formed by attaching two rectangular pieces together; and attaching the four square-shaped quarter portions together to form a square-shaped block having the eight-point star thereon.

4. The method of claim 3, wherein the two rectangular pieces comprise a first rectangular piece made of a rectangular piece attached to a square piece and a second rectangular piece that is attached to the first rectangular piece.

5. The method of claim 4, wherein the first rectangular piece is formed of material that is visually-contrasting to material of the second rectangular piece and the square piece.

6. A method of forming a fabric block, comprising:

forming two square-shaped fabric segments, each square-shaped fabric segment formed from a first rectangular piece sewn to a square piece and further sewn to a second rectangular piece;

sewing the two square-shaped fabric segments together to form a square-shaped quarter portion depicting two points of a star; and sewing the four square-shaped quarter portions together to form a fabric block depicting an eight-point star.

7. The method of claim 6, wherein the first rectangular piece is formed of material that visually contrasts with the material of the square and the second rectangular piece.

8. The method of claim 6, comprising forming the first and second rectangular pieces to be of the same length and shape, and forming the square piece to be of the same width of the first rectangular piece and approximately one-half of the length of the first rectangular piece.

9. A fabric block depicting an eight-point star, comprising:

four square-shaped fabric pieces attached together, each of the four square-shaped fabric pieces depicting two points of an eight-point star and comprising two square-shaped fabric segments attached together, each square-shaped fabric segment formed from first and second rectangular fabric pieces sewn to a square fabric piece.

10. The fabric block of claim 9, wherein the first rectangular fabric piece is formed of material that visually contrasts with material of the second rectangular fabric piece and the square fabric piece.

11. The fabric block of claim 9, wherein the first rectangular fabric piece and the second rectangular fabric piece are formed to have the same length, and the square fabric piece is formed to have a width equal to a width of the first rectangular fabric piece and a length equal to approximately one-half of a length of the first rectangular fabric piece.

12. The fabric block of claim 9, wherein the two square-shaped fabric segments are sewn diagonally from one corner to another corner.

13. The fabric block of claim 9, wherein the square fabric piece is sewn to the first rectangular fabric piece by stitching sewn diagonally from one corner of the square fabric piece to a second corner of the square fabric piece.

14. An eight-point star formed of fabric, comprising:

two rectangular-shaped pieces, each depicting one-half of an eight-point star, sewn together to form a square-shaped fabric piece depicting an eight-point star, each rectangular shape piece comprising:

two square-shaped quarter portions attached together, each square-shaped quarter portion comprising:

square-shaped first and second units, each of the first and second units formed of a rectangular-shaped combination attached to a rectangular piece, each of the rectangular-shaped combinations comprising a square-shaped piece of material attached to a lower portion of a piece of rectangular material.

15. A method of making a quilt, comprising:

combining a plurality of fabric blocks together, each fabric block formed by:

forming two square-shaped fabric segments, each square-shaped fabric segment formed from a first rectangular piece sewn to a square piece and further sewn to a second rectangular piece;

sewing the two square-shaped fabric segments together to form a square-shaped quarter portion depicting two points of an eight-point star; and sewing the four square-shaped quarter portions together to form a fabric block depicting an eight-point star.

* * * * *